United States Patent [19]

Hediger et al.

[11] Patent Number: 4,893,740

[45] Date of Patent: Jan. 16, 1990

[54] WEB TRACKING MECHANISM

[75] Inventors: Edwin A. Hediger, Fairport; Michael Kenin; Peter G. Izzo, both of Rochester, all of N.Y.

[73] Assignee: Eastman Kodak Company, Rochester, N.Y.

[21] Appl. No.: 274,177

[22] Filed: Nov. 21, 1988

[51] Int. Cl.[4] ..... B65H 23/025

[52] U.S. Cl. ..... 226/23; 226/18; 226/21

[58] Field of Search ..... 226/15, 16, 17, 18, 226/19, 20, 21, 22, 23

[56] References Cited

U.S. PATENT DOCUMENTS

| | | | |
|---|---|---|---|
| 3,693,781 | 9/1972 | Homeier | 226/23 X |
| 4,174,171 | 11/1979 | Hamaker et al. | 226/20 |
| 4,572,417 | 2/1986 | Joseph et al. | 226/20 |
| 4,641,770 | 2/1987 | Hediger | 226/23 |

*Primary Examiner*—Joseph J. Hail, III

*Attorney, Agent, or Firm*—Lawrence P. Kessler

[57] ABSTRACT

Apparatus for controlling the lateral movement of a travelling web to automatically compensate for web conicity and angular deviation of the web velocity vector. A preferred embodiment of the apparatus comprises a steering roller about which a travelling web is at least in part entrained. An assembly supports the steering roller for rotation about its longitudinal axis, and mounts the steering roller for angular adjustment about a caster axis perpendicular to such longitudinal axis at the mid-point of the steering roller. The assembly is, in turn, supported for rotation about a gimbal axis intersecting, and perpendicular to, the caster axis. Lateral movement of a web supported on the steering roller is sensed relative to the steering roller in the direction of the longitudinal axis of the steering roller. The mechanism for sensing lateral movement of the web moves in a corresponding direction to the sensed lateral movement of the web. The sensing mechanism is interconnected with the supporting and mounting assembly for angularly adjusting the steering roller about the caster axis in response to movement of the lateral movement sensing mechanism, in a direction to counteract sensed lateral movement of the web.

8 Claims, 3 Drawing Sheets

WEB TRACKING MECHANISM

BACKGROUND OF THE INVENTION

This invention is directed in general to mechanisms for tracking moving webs, and more particularly to a simplified web tracking mechanism which provides for automatic control of lateral movement of a web.

Electrostatographic reproduction apparatus employ a sensitized member upon which an image of information to be reproduced is formed. The sensitized member is typically a drum or continuous web of material adapted to move so as to present an area of the member successively to electrostatographic process stations. For certain reproduction apparatus, the continuous web sensitized member has certain advantages over the drum in that it is generally less expensive and easier to replace at the end of its functional life or when inadvertently damaged.

The sensitized member of the continuous web type is typically supported by, and driven about, a plurality of rollers which serve to define a desired travel path relative to the electrostatographic process stations. Manufacturing tolerances associated with making of a continuous web results in a degree of conicity in the continuous web. Also, due to the inability to manufacture perfectly cylindrical rollers or exactly mount the rollers in a web supporting system, the velocity vector of a traveling web frequently approaches the longitudinal axis of a support roller at an angle other than substantially normal to such axis. As a result of the conicity of the continuous web and the angular deviation of the web velocity vector from normal with respect to the support roller axis, a moving web has the undesirable tendency to move laterally with respect to its desired travel path. If not controlled, such lateral movement results in misalignment of the web with the electrostatographic process stations thereby causing failure of the reproduction apparatus to make copies of acceptable quality. Ultimately, it can lead to destruction of the web.

Various mechanisms for correcting for lateral (cross-track) movement of a web have heretofore been utilized. Such mechanisms include for example servo actuated steering rollers (such as shown for example in U.S. Pat. No. 4,572,417, issued Feb. 25, 1986, in the name of Joseph et al.) and self-activated steering rollers (such as shown for example in U.S. Pat. No. 4,397,538, issued Aug. 9, 1983, in the name of Castelli et al.). In order to compensate for web conicity and angular deviation of the web velocity vector, such mechanisms are generally of a complex construction and high cost.

SUMMARY OF THE INVENTION

This invention is directed to a simplified apparatus for controlling the lateral movement of a travelling web to automatically compensate for web conicity and angular deviation of the web velocity vector. A preferred embodiment of the apparatus comprises a steering roller about which a travelling web is at least in part entrained. An assembly supports the steering roller for rotation about its longitudinal axis, and mounts the steering roller for angular adjustment about a caster axis perpendicular to such longitudinal axis at the mid-point of the steering roller. The assembly is, in turn, supported for rotation about a gimbal axis intersecting, and perpendicular to, the caster axis. Lateral movement of a web supported on the steering roller is sensed relative to the steering roller in the direction of the longitudinal axis of the steering roller. The mechanism for sensing lateral movement of the web moves in a corresponding direction to the sensed lateral movement of the web. The sensing mechanism is interconnected with the supporting and mounting assembly for angularly adjusting said steering roller about said caster axis in response to movement of the lateral movement sensing mechanism, in a direction to counteract sensed lateral movement of the web.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
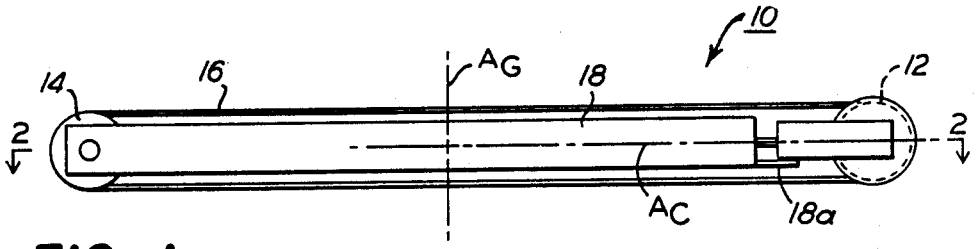
FIG. 1 is a side elevational view of the web tracking mechanism according to this invention.
Figure 2:
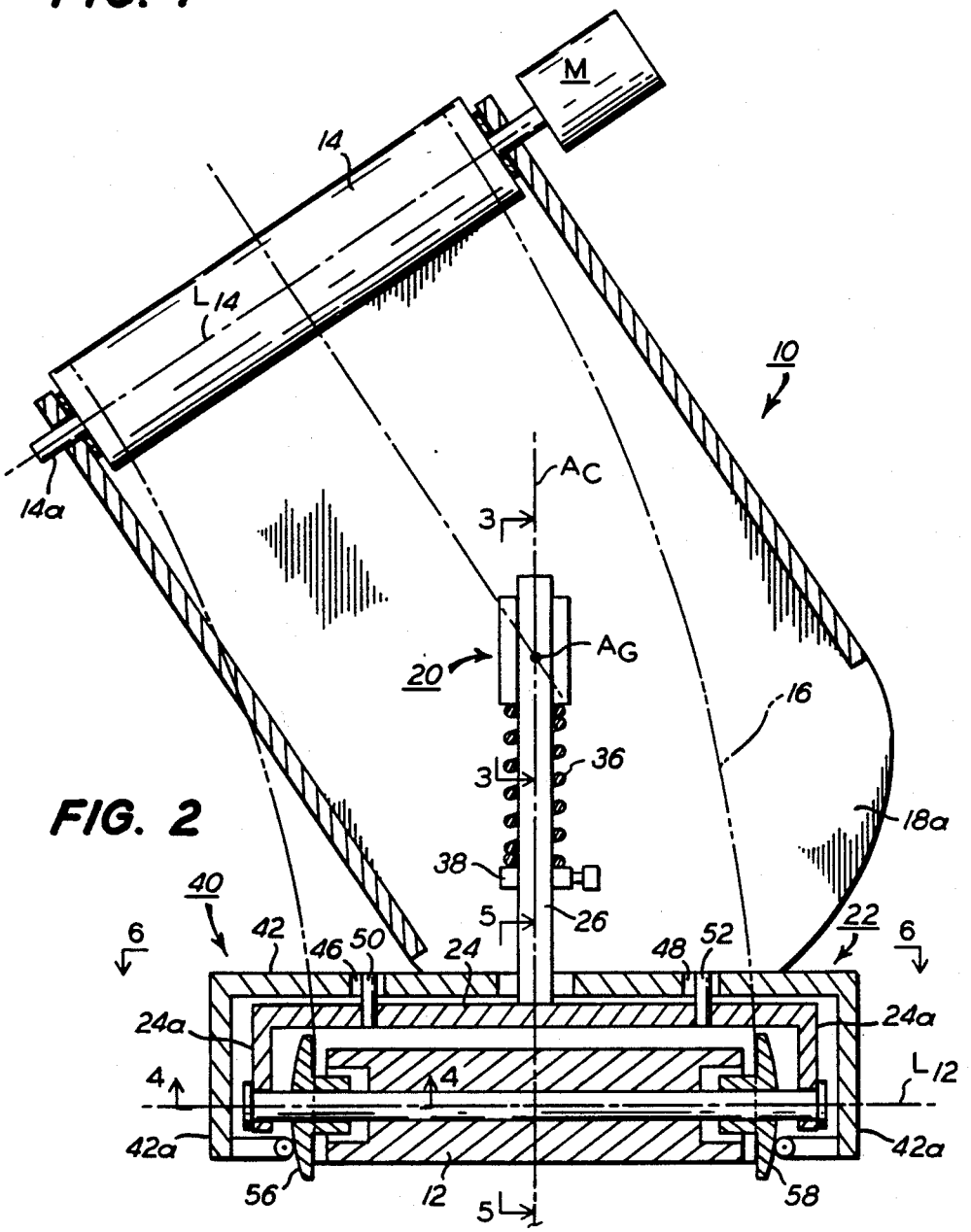
FIG. 2 is a plan view of the web tracking mechanism, in cross-section taken along lines 2—2 of FIG. 1.

Referring now to the accompanying drawings, the web tracking apparatus according to this invention, designated by the numeral 10, is best shown in FIGS. 1 and 2. The web tracking apparatus 10 includes a steering roller 12 and an opposed roller 14 about which a closed loop web 16 is entrained. The rollers 12, 14 of the apparatus 10 define a travel path for the web 16, such as for example through process stations of an electrostatographic reproduction apparatus (not shown). Of course, this invention is suitable for use with other apparatus which require roller arrangements for supporting a travelling web.

The web tracking apparatus 10 according to this invention is capable of automatically accommodating for any conicity in the closed loop web and any imperfections in the rollers (or their mountings) which may cause the velocity vector of a traveling web to approach the longitudinal axis of a roller at an angle other than substantially normal to such axis. As noted above, the conicity of a closed loop web and the angular deviation of the web velocity vector from normal with respect to a roller axis results in the moving web having the undesirable tendency to move laterally (in a cross track direction) with respect to its desired travel path.

The web tracking apparatus 10 includes a frame 18 held at a fixed location by any suitable mechanism (not shown). The frame 18, adjacent one end, supports the shaft 14a of roller 14 so that the roller is rotatable about its longitudinal axis $L_{14}$. The shaft 14a is coupled to a motor M which selectively rotates the roller 14 to move the web 16 about its travel path. The frame 18 also supports an assembly 20 which, in turn, supports an assembly 22 for supporting the steering roller 12 for rotation about its longitudinal axis $L_{12}$ and mounting the steering roller for angular adjustment about a caster axis $A_C$. The assembly 20 enables the assembly 22 (and thus the steering roller12) to rotate about a gimbal axis $A_G$.

Figure 3:
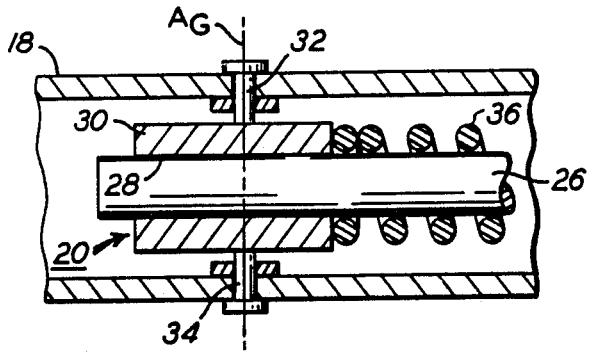
FIG. 3 is a side elevational view of a portion of the steering roller support and mounting assembly of the web tracking apparatus taken along lines 3—3 of FIG. 2.

The assembly 22 includes a yoke 24 having a pair of arms 24a carrying the shaft 12a of the steering roller 12 so that the steering roller is rotatable about its longitudinal axis $L_{12}$. The portion of the yoke 24 interconnecting the arms 24a has a member 26 attached thereto extending away from the steering roller 12 along a line coincident with a line perpendicular to axis $L_{12}$ and intersecting the steering roller at its mid-point. The member 26 is in the form of a substantially cylindrical rod. The rod is received in a complimentary shaped bore 28 of a housing 30 of the assembly 20. The housing 30 is supported in the frame 18 on pivot pins 32, 34 (see FIG. 3) to establish the gimbal axis $A_G$. As best seen in FIG. 2, the gimbal axis $A_G$ is located to pass through the intersection of of the lines respectively perpendicular to the rollers 12 and 14 at their mid-points and is at a distance substantially half way between the housing 30 and a stop 38 fixed to the member 26 urges the steering roller in a direction so that a web entrained about the rollers (e.g., the web 16 shown in phantom in FIG. 2) is under tension. Because the steering roller 12 is supported for rotation about the gimbal axis $A_G$, the steering roller is able to assume a position to automatically accommodate for web conicity (shown in an exaggerated condition in FIG. 2). Furthermore, due to the central location of the gimbal axis $A_G$ relative to the respective roller mid-points, the tension in the web in the cross-track direction is equalized. Therefore, the tendency for the web to move laterally due to web conicity and/or unequal cross-track tension in the web is substantially prevented.

Figure 5:
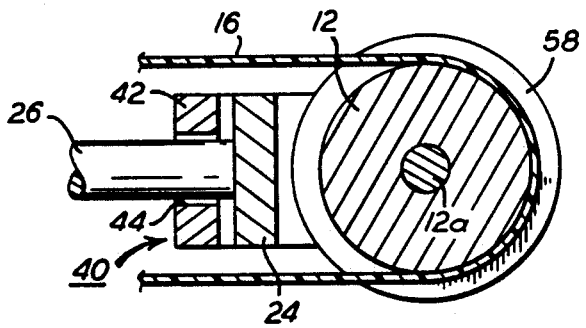
FIG. 5 is an end elevational view of another portion of the steering roller support and mounting assembly, in cross-section taken along lines 5—5 of FIG. 2.
Figure 4:
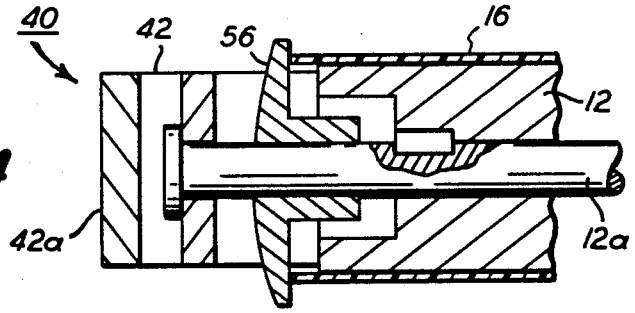
FIG. 4 is a side elevational view of a portion of the steering roller support and mounting assembly, in cross-section taken along lines 4—4 of FIG. 2.
Figure 6:
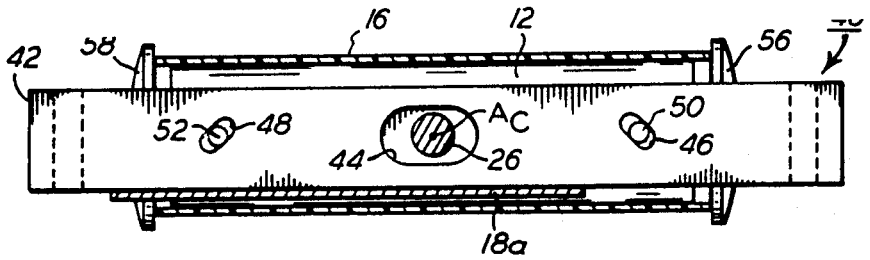
FIG. 6 is an end elevational view of a portion of the steering roller support and mounting assembly, taken along lines 6—6 of FIG. 2.
Figure 6A:
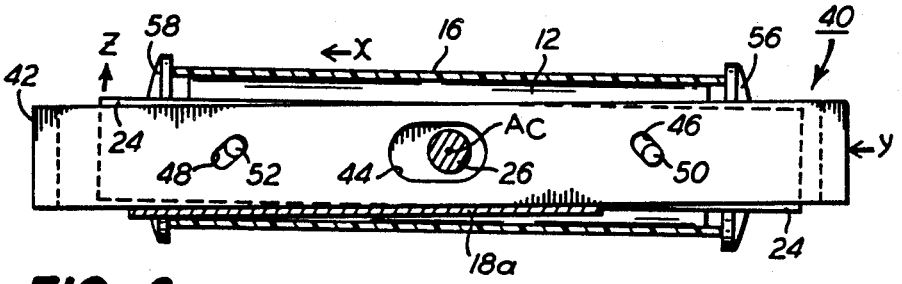
FIG. 6*a* is an end elevational view similar to the view of FIG. 6 showing the steering roller angularly adjusted to counteract lateral movement of the web.

The assembly 22 also includes a yoke driver 40 for effecting automatic rotation of the steering roller 12 about the caster axis $A_C$. The yoke driver 40 is a substantially U-shaped member 42 located between the yoke 24 and the frame 18 and supported on portion 18a of the frame. The member 42 has an opening 44 through which member 26 freely passes (see FIG. 4), and a pair of slots 46 and 48 for respectively receiving pins 50 and 52 carried by the yoke 24. Additionally, arms 42a of the member 42 respectively carry followers 54 which engage web edge sensors 56, 58. The web edge sensors 56, 58 (one shown in FIG. 5) are flange-like members freely supported by the shaft 12a of the steering roller 12. When the web moves laterally with respect to the steering roller due to the angular deviation of the web velocity vector from normal with respect to the steering roller axis, the beam strength of the web is sufficient to move the sensor engaged with the web in a like direction. Movement of a sensor 56 or 58 causes a corresponding movement of the engaged follower 54 and thus a corresponding movement of of the yoke driver 40. Referring to FIGS. 6 and 6a, it can be seen that slots 46 and 48 are substantially equidistant from the geometric center of the yoke driver 40, and are oriented in opposite directions at an angle to the longitudinal axis $L_{40}$ of the yoke driver. Therefore, when the web 16 moves laterally with respect to the steering roller 12 in the direction of arrow X from its position in FIG. 6 to that shown in FIG. 6a, sensor 58 will move in the same direction to cause movement of the yoke driver 40 in the direction of arrow Y. The edge surfaces of the slots 46 and 48 will then act respectively on the pins 50 and 52 to effect rotation of the yoke 24 in the direction of the arrow Z about the caster axis $A_C$. The steering roller 12 is accordingly rotated about the caster axis from the position shown in FIG. 6 to the position shown in FIG. 6a which will counteract the lateral movement of the web, thereby substantially preventing cross-track deviation of the web from its desired travel path due to the aforementioned angular deviation of the web velocity vector from normal with respect to the steering roller axis.

Figure 7:
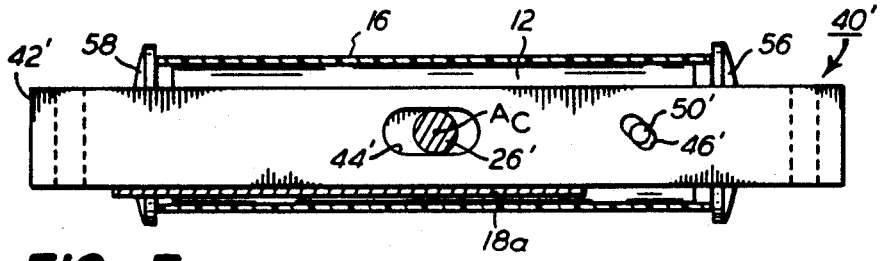
FIGS. 7 and 7*a* are views similar to FIGS. 6 and 6*a*, respectively, showing an alternate embodiment for the steering roller support and mounting assembly according to this invention.
Figure 7A:
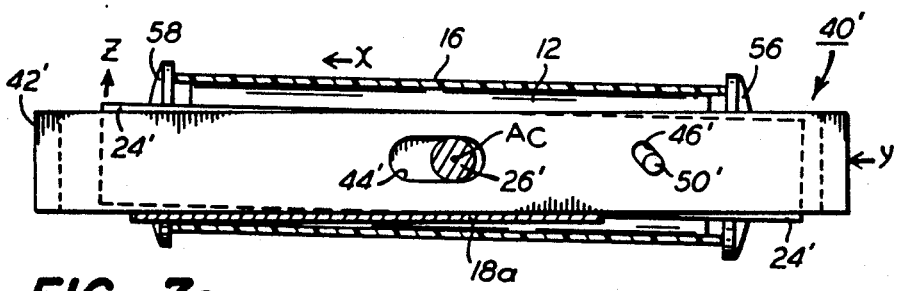

In an alternate embodiment of the assembly 22 according to this invention, a yoke driver 40' (see FIGS. 7 and 7a) has substantially the same construction and functional operation as yoke driver 40. However, opening 44' has a dimension in the vertical direction substantially equal to the diameter of the member 26', and only one angularly oriented slot 46' and pin 50' arrangement is provided. With this alternate construction, the relative movement of the yoke driver 40' to the yoke 24' causes the above-described angular adjustment of the steering roller, while assuring that the member 26' is accurately retained at a given location in a vertical plane through the member.

The invention has been described in detail with particular reference to preferred embodiments thereof, but it will be understood that variations and modifications can be effected within the spirit and scope of the invention.

We claim:

1. Apparatus for controlling the lateral movement of a travelling web, said apparatus comprising;

a steering roller about which a travelling web is at least in part entrained;

first means for supporting said steering roller for rotation about its longitudinal axis, and for mounting said steering roller for angular adjustment about a caster axis perpendicular to such longitudinal axis at the mid-point of said steering roller;

second means for supporting said first means for rotation about a gimbal axis intersecting, and perpendicular to, said caster axis;

sensing means for engaging at least one edge of said web to sense lateral movement of a web supported on said steering roller relative to said steering roller in the direction of said longitudinal axis, said sensing means moving in a corresponding direction to sensed lateral movement of said web; and a member associated with said sensing means so as to follow said sensing means, said member including at least one slot defined therein at an angle to the direction of movement thereof, and at least one pin attached to said first means, said pin engaging said slot whereby movement of said slot effects movement of said pin in a direction transverse to the direction of movement of said slot to rotate said first means and thus said steering roller about said caster axis in response to movement of said sensing means to counteract sensed lateral movement of said web.

2. The invention of claim 1 wherein two slots are defined in said member, said slots being spaced at equal distances and on opposite sides from the mid point of said steering roller, said slots being respectively oriented at complimentary angles, and a pair of pins attached to said supporting and mounting means, said pins engaging said slots respectively.

3. In a structure having a continuous loop web entrained about at least a steering roller and an opposing roller for movement along a desired travel path, apparatus for controlling the lateral movement of said web as it moves about said desired path, said apparatus comprising;

a frame;

first means associated with said frame for supporting said opposing roller for rotation about its longitudinal axis;

second means for supporting said steering roller for rotation about its longitudinal axis, and for mounting said steering roller for angular adjustment about a caster axis perpendicular to such longitudinal axis at the mid-point of said steering roller;

third means associated with said frame for supporting said second means for rotation about a gimbal axis intersecting, and perpendicular to, said caster axis so as to accommodate automatically for any conicity in said closed loop web;

fourth means for sensing lateral movement of a web supported on said steering roller relative to said steering roller in the direction of said longitudinal axis, said fourth means mounted on said steering roller and moving in a corresponding direction to sensed lateral movement of said web; and fifth means interconnecting said fourth means and said second means for angularly adjusting said steering roller about said caster axis in response to movement of said fourth means, in a direction to counteract sensed lateral movement of said web.

4. The invention of claim 3 wherein said gimbal axis passes through a point located at the intersection of a line perpendicular to the longitudinal axis of said steering roller at the mid-point thereof and a line perpendicular to the longitudinal axis of said opposing roller through the mid-point thereof.

5. The invention of claim 4 wherein said second means includes a yoke, a shaft supported for rotation by said yoke, said steering roller being supported on said shaft for rotation therewith, and an elongated member extending from said yoke perpendicular to the axis of said shaft, the longitudinal axis of said elongated member intersecting said shaft at the mid-point of said steering roller.

6. The invention of claim 5 wherein said third means includes a member carried by said frame, said member configured to have an opening for receiving said elongated member of said second means so that said elongated member can move relative to said member along the longitudinal axis of said elongated member and rotate thereabout, and means for urging said elongated member in a direction along its longitudinal axis to move said steering roller away from said opposing roller.

7. The invention of claim 6 wherein said fourth means includes a means engaging at least one edge of said web, and said fifth means includes a member associated with said engaging means so as to follow said engaging means, and at least one slot defined in said member at an angle to the direction of movement of said member, and at least one pin attached to said second means, said pin engaging said slot whereby movement of said slot effects movement of said pin in a direction transverse to the direction of movement of said slot to rotate said second and thus said steering roller about said caster axis.

8. The invention of claim 7 wherein said fifth means includes two slots defined in said member, said slots being spaced at equal distances and on opposite sides from the mid point of said steering roller, said slots being respectively oriented at complimentary angles, and a pair of pins attached to said second means, said pins engaging said slots respectively.

* * * * *